US009685164B2

(12) United States Patent
Atti et al.

(10) Patent No.: US 9,685,164 B2
(45) Date of Patent: Jun. 20, 2017

(54) SYSTEMS AND METHODS OF SWITCHING CODING TECHNOLOGIES AT A DEVICE

(71) Applicant: QUALCOMM Incorporated, San Diego, CA (US)

(72) Inventors: Venkatraman S. Atti, San Diego, CA (US); Venkatesh Krishnan, San Diego, CA (US)

(73) Assignee: QUALCOMM Incorporated, San Diego, CA (US)

( * ) Notice: Subject to any disclaimer, the term of this patent is extended or adjusted under 35 U.S.C. 154(b) by 62 days.

(21) Appl. No.: 14/671,757

(22) Filed: Mar. 27, 2015

(65) Prior Publication Data

US 2015/0279382 A1 Oct. 1, 2015

Related U.S. Application Data

(60) Provisional application No. 61/973,028, filed on Mar. 31, 2014.

(51) Int. Cl.

| | |
|---|---|
| ***G10L 19/00*** | (2013.01) |
| ***G10L 19/02*** | (2013.01) |
| ***G10L 19/12*** | (2013.01) |
| ***G10L 19/20*** | (2013.01) |
| ***G10L 21/038*** | (2013.01) |

(52) U.S. Cl.

CPC ..... *G10L 19/02* (2013.01); *G10L 19/12* (2013.01); *G10L 19/20* (2013.01); *G10L 21/038* (2013.01)

(58) Field of Classification Search

USPC ..... 704/500–504

See application file for complete search history.

(56) References Cited

U.S. PATENT DOCUMENTS

| | | | | |
|---|---|---|---|---|
| 5,974,380 | A * | 10/1999 | Smyth | G10L 19/0208 704/201 |
| 5,978,762 | A * | 11/1999 | Smyth | G10L 19/0208 704/500 |
| 6,012,024 | A | 1/2000 | Hofmann | |
| 6,351,730 | B2 * | 2/2002 | Chen | 704/219 |
| 6,487,535 | B1 * | 11/2002 | Smyth | G10L 19/0208 704/500 |
| 9,280,976 | B2 * | 3/2016 | Vasilache | G10L 19/008 |
| 2002/0015448 | A1 * | 2/2002 | Honjo | G11B 27/034 375/240.25 |
| 2005/0185935 | A1 * | 8/2005 | Asakura | G11B 27/034 386/216 |

(Continued)

OTHER PUBLICATIONS

International Search Report and Written Opinion of the International Searching Authority (EPO) for International Application No. PCT/US2015/023398, mailed Jul. 2, 2015, 16 pages.

*Primary Examiner* — Leonard Saint Cyr

(74) *Attorney, Agent, or Firm* — Toler Law Group, PC

(57) ABSTRACT

A particular method includes encoding a first frame of an audio signal using a first encoder. The method also includes generating, during encoding of the first frame, a baseband signal that includes content corresponding to a high band portion of the audio signal. The method further includes encoding a second frame of the audio signal using a second encoder, where encoding the second frame includes processing the baseband signal to generate high band parameters associated with the second frame.

40 Claims, 8 Drawing Sheets

(56) References Cited

U.S. PATENT DOCUMENTS

| | | | | |
|---|---|---|---|---|
| 2006/0034260 | A1* | 2/2006 | Svedberg | H04W 4/10 370/352 |
| 2007/0282599 | A1 | 12/2007 | Choo et al. | |
| 2010/0114583 | A1* | 5/2010 | Lee | G10L 19/025 704/500 |
| 2011/0173008 | A1 | 7/2011 | Lecomte et al. | |
| 2011/0295598 | A1* | 12/2011 | Yang | G10L 21/038 704/205 |
| 2012/0245947 | A1* | 9/2012 | Neuendorf | G10L 19/20 704/500 |
| 2013/0030798 | A1 | 1/2013 | Mittal et al. | |
| 2013/0185075 | A1 | 7/2013 | Tsujino et al. | |

* cited by examiner

SYSTEMS AND METHODS OF SWITCHING CODING TECHNOLOGIES AT A DEVICE

I. CLAIM OF PRIORITY

The present application claims priority from U.S. Provisional Application No. 61/973,028, filed Mar. 31, 2014, which is entitled "SYSTEMS AND METHODS OF SWITCHING CODING TECHNOLOGIES AT A DEVICE," the content of which is incorporated by reference in its entirety.

II. FIELD

The present disclosure is generally related to switching coding technologies at a device.

III. DESCRIPTION OF RELATED ART

Advances in technology have resulted in smaller and more powerful computing devices. For example, there currently exist a variety of portable personal computing devices, including wireless computing devices, such as portable wireless telephones, personal digital assistants (PDAs), and paging devices that are small, lightweight, and easily carried by users. More specifically, portable wireless telephones, such as cellular telephones and Internet Protocol (IP) telephones, can communicate voice and data packets over wireless networks. Further, many such wireless telephones include other types of devices that are incorporated therein. For example, a wireless telephone can also include a digital still camera, a digital video camera, a digital recorder, and an audio file player.

Wireless telephones send and receive signals representative of human voice (e.g., speech). Transmission of voice by digital techniques is widespread, particularly in long distance and digital radio telephone applications. There may be an interest in determining the least amount of information that can be sent over a channel while maintaining a perceived quality of reconstructed speech. If speech is transmitted by sampling and digitizing, a data rate on the order of sixty-four kilobits per second (kbps) may be used to achieve a speech quality of an analog telephone. Through the use of speech analysis, followed by coding, transmission, and re-synthesis at a receiver, a significant reduction in the data rate may be achieved.

Devices for compressing speech may find use in many fields of telecommunications. An exemplary field is wireless communications. The field of wireless communications has many applications including, e.g., cordless telephones, paging, wireless local loops, wireless telephony, such as cellular and personal communication service (PCS) telephone systems, mobile IP telephony, and satellite communication systems. A particular application is wireless telephony for mobile subscribers.

Various over-the-air interfaces have been developed for wireless communication systems including, e.g., frequency division multiple access (FDMA), time division multiple access (TDMA), code division multiple access (CDMA), and time division-synchronous CDMA (TD-SCDMA). In connection therewith, various domestic and international standards have been established including, e.g., Advanced Mobile Phone Service (AMPS), Global System for Mobile Communications (GSM), and Interim Standard 95 (IS-95). An exemplary wireless telephony communication system is a CDMA system. The IS-95 standard and its derivatives, IS-95A, American National Standards Institute (ANSI) J-STD-008, and IS-95B (referred to collectively herein as IS-95), are promulgated by the Telecommunication Industry Association (TIA) and other standards bodies to specify the use of a CDMA over-the-air interface for cellular or PCS telephony communication systems.

The IS-95 standard subsequently evolved into "3G" systems, such as cdma2000 and wideband CDMA (WCDMA), which provide more capacity and high speed packet data services. Two variations of cdma2000 are presented by the documents IS-2000 (cdma2000 1xRTT) and IS-856 (cdma2000 1xEV-DO), which are issued by TIA. The cdma2000 1xRTT communication system offers a peak data rate of 153 kbps whereas the cdma2000 1xEV-DO communication system defines a set of data rates, ranging from 38.4 kbps to 2.4 Mbps. The WCDMA standard is embodied in 3rd Generation Partnership Project "3GPP", Document Nos. 3G TS 25.211, 3G TS 25.212, 3G TS 25.213, and 3G TS 25.214. The International Mobile Telecommunications Advanced (IMT-Advanced) specification sets out "4G" standards. The IMT-Advanced specification sets peak data rate for 4G service at 100 megabits per second (Mbit/s) for high mobility communication (e.g., from trains and cars) and 1 gigabit per second (Gbit/s) for low mobility communication (e.g., from pedestrians and stationary users).

Devices that employ techniques to compress speech by extracting parameters that relate to a model of human speech generation are called speech coders. Speech coders may include an encoder and a decoder. The encoder divides the incoming speech signal into blocks of time, or analysis frames. The duration of each segment in time (or "frame") may be selected to be short enough that the spectral envelope of the signal may be expected to remain relatively stationary. For example, one frame length is twenty milliseconds, which corresponds to 160 samples at a sampling rate of eight kilohertz (kHz), although any frame length or sampling rate deemed suitable for the particular application may be used.

The encoder analyzes the incoming speech frame to extract certain relevant parameters, and then quantizes the parameters into binary representation, e.g., to a set of bits or a binary data packet. The data packets are transmitted over a communication channel (e.g., a wired and/or wireless network connection) to a receiver and a decoder. The decoder processes the data packets, unquantizes the processed data packets to produce the parameters, and resynthesizes the speech frames using the unquantized parameters.

The function of the speech coder is to compress the digitized speech signal into a low-bit-rate signal by removing natural redundancies inherent in speech. The digital compression may be achieved by representing an input speech frame with a set of parameters and employing quantization to represent the parameters with a set of bits. If the input speech frame has a number of bits Ni and a data packet produced by the speech coder has a number of bits No, the compression factor achieved by the speech coder is Cr=Ni/No. The challenge is to retain high voice quality of the decoded speech while achieving the target compression factor. The performance of a speech coder depends on (1) how well the speech model, or the combination of the analysis and synthesis process described above, performs, and (2) how well the parameter quantization process is performed at the target bit rate of No bits per frame. The goal of the speech model is thus to capture the essence of the speech signal, or the target voice quality, with a small set of parameters for each frame.

Speech coders generally utilize a set of parameters (including vectors) to describe the speech signal. A good set of parameters ideally provides a low system bandwidth for the reconstruction of a perceptually accurate speech signal. Pitch, signal power, spectral envelope (or formants), amplitude and phase spectra are examples of the speech coding parameters.

Speech coders may be implemented as time-domain coders, which attempt to capture the time-domain speech waveform by employing high time-resolution processing to encode small segments of speech (e.g., 5 millisecond (ms) sub-frames) at a time. For each sub-frame, a high-precision representative from a codebook space is found by means of a search algorithm. Alternatively, speech coders may be implemented as frequency-domain coders, which attempt to capture the short-term speech spectrum of the input speech frame with a set of parameters (analysis) and employ a corresponding synthesis process to recreate the speech waveform from the spectral parameters. The parameter quantizer preserves the parameters by representing them with stored representations of code vectors in accordance with known quantization techniques.

One time-domain speech coder is the Code Excited Linear Predictive (CELP) coder. In a CELP coder, the short-term correlations, or redundancies, in the speech signal are removed by a linear prediction (LP) analysis, which finds the coefficients of a short-term formant filter. Applying the short-term prediction filter to the incoming speech frame generates an LP residual signal, which is further modeled and quantized with long-term prediction filter parameters and a subsequent stochastic codebook. Thus, CELP coding divides the task of encoding the time-domain speech waveform into the separate tasks of encoding the LP short-term filter coefficients and encoding the LP residual. Time-domain coding can be performed at a fixed rate (e.g., using the same number of bits, No, for each frame) or at a variable rate (in which different bit rates are used for different types of frame contents). Variable-rate coders attempt to use the amount of bits needed to encode the codec parameters to a level adequate to obtain a target quality.

Time-domain coders, such as the CELP coder, may rely upon a high number of bits, NO, per frame to preserve the accuracy of the time-domain speech waveform. Such coders may deliver excellent voice quality provided that the number of bits, No, per frame is relatively large (e.g., 8 kbps or above). At low bit rates (e.g., 4 kbps and below), time-domain coders may fail to retain high quality and robust performance due to the limited number of available bits. At low bit rates, the limited codebook space clips the waveform-matching capability of time-domain coders, which are deployed in higher-rate commercial applications. Hence, despite improvements over time, many CELP coding systems operating at low bit rates suffer from perceptually significant distortion characterized as noise.

An alternative to CELP coders at low bit rates is the "Noise Excited Linear Predictive" (NELP) coder, which operates under similar principles as a CELP coder. NELP coders use a filtered pseudo-random noise signal to model speech, rather than a codebook. Since NELP uses a simpler model for coded speech, NELP achieves a lower bit rate than CELP. NELP may be used for compressing or representing unvoiced speech or silence.

Coding systems that operate at rates on the order of 2.4 kbps are generally parametric in nature. That is, such coding systems operate by transmitting parameters describing the pitch-period and the spectral envelope (or formants) of the speech signal at regular intervals. Illustrative of these so-called parametric coders is the LP vocoder system.

LP vocoders model a voiced speech signal with a single pulse per pitch period. This basic technique may be augmented to include transmission information about the spectral envelope, among other things. Although LP vocoders provide reasonable performance generally, they may introduce perceptually significant distortion, characterized as buzz.

In recent years, coders have emerged that are hybrids of both waveform coders and parametric coders. Illustrative of these so-called hybrid coders is the prototype-waveform interpolation (PWI) speech coding system. The PWI coding system may also be known as a prototype pitch period (PPP) speech coder. A PWI coding system provides an efficient method for coding voiced speech. The basic concept of PWI is to extract a representative pitch cycle (the prototype waveform) at fixed intervals, to transmit its description, and to reconstruct the speech signal by interpolating between the prototype waveforms. The PWI method may operate either on the LP residual signal or the speech signal.

A communication device may receive a speech signal with lower than optimal voice quality. To illustrate, the communication device may receive the speech signal from another communication device during a voice call. The voice call quality may suffer due to various reasons, such as environmental noise (e.g., wind, street noise), limitations of the interfaces of the communication devices, signal processing by the communication devices, packet loss, bandwidth limitations, bit-rate limitations, etc.

In traditional telephone systems (e.g., public switched telephone networks (PSTNs)), signal bandwidth is limited to the frequency range of 300 Hertz (Hz) to 3.4 kHz. In wideband (WB) applications, such as cellular telephony and voice over internet protocol (VoIP), signal bandwidth may span the frequency range from 50 Hz to 7 kHz. Super wideband (SWB) coding techniques support bandwidth that extends up to around 16 kHz. Extending signal bandwidth from narrowband telephony at 3.4 kHz to SWB telephony of 16 kHz may improve the quality of signal reconstruction, intelligibility, and naturalness.

One WB/SWB coding technique is bandwidth extension (BWE), which involves encoding and transmitting the lower frequency portion of the signal (e.g., 0 Hz to 6.4 kHz, also called the "low band"). For example, the low band may be represented using filter parameters and/or a low band excitation signal. However, in order to improve coding efficiency, the higher frequency portion of the signal (e.g., 6.4 kHz to 16 kHz, also called the "high band") may not be fully encoded and transmitted. Instead, a receiver may utilize signal modeling to predict the high band. In some implementations, data associated with the high band may be provided to the receiver to assist in the prediction. Such data may be referred to as "side information," and may include gain information, line spectral frequencies (LSFs, also referred to as line spectral pairs (LSPs)), etc.

In some wireless telephones, multiple coding technologies are available. For example, different coding technologies may be used to encode different types of audio signal (e.g., voice signals vs. music signals). When the wireless telephone switches from using a first encoding technology to encode an audio signal to using a second encoding technology to encode the audio signal, audible artifacts may be generated at frame boundaries of the audio signal due to the resetting of memory buffers within the encoders.

IV. SUMMARY

Systems and methods of reducing frame boundary artifacts and energy mismatches when switching coding technologies at a device are disclosed. For example, a device may use a first encoder, such as a modified discrete cosine transform (MDCT) encoder, to encode a frame of an audio signal that contains substantial high-frequency components. For example, the frame may contain background noise, noisy speech, or music. The device may use a second encoder, such as an algebraic code-excited linear prediction (ACELP) encoder, to encode a speech frame that does not contain substantial high-frequency components. One or both of the encoders may apply a BWE technique. When switching between the MDCT encoder and the ACELP encoder, memory buffers used for BWE may be reset (e.g., populated with zeroes) and filter states may be reset, which may cause frame boundary artifacts and energy mismatches.

In accordance with the described techniques, instead of resetting (or "zeroing out") a buffer and resetting a filter, one encoder may populate the buffer and determine filter settings based on information from the other encoder. For example, when encoding a first frame of an audio signal, the MDCT encoder may generate a baseband signal that corresponds to a high band "target," and the ACELP encoder may use the baseband signal to populate a target signal buffer and generate high band parameters for a second frame of the audio signal. As another example, the target signal buffer may be populated based on a synthesized output of the MDCT encoder. As yet another example, the ACELP encoder may estimate a portion of the first frame using extrapolation techniques, signal energy, frame type information (e.g., whether the second frame and/or the first frame is an unvoiced frame, a voiced frame, a transient frame, or a generic frame), etc.

During signal synthesis, decoders may also perform operations to reduce frame boundary artifacts and energy mismatches due to switching of coding technologies. For example, a device may include a MDCT decoder and an ACELP decoder. When the ACELP decoder decodes a first frame of an audio signal, the ACELP decoder may generate a set of "overlap" samples corresponding to a second (i.e., next) frame of the audio signal. If a coding technology switch occurs at the frame boundary between the first and second frames, the MDCT decoder may perform a smoothing (e.g., crossfade) operation during decoding of the second frame based on the overlap samples from the ACELP decoder to increase perceived signal continuity at the frame boundary.

In a particular aspect, a method includes encoding a first frame of an audio signal using a first encoder. The method also includes generating, during encoding of the first frame, a baseband signal that includes content corresponding to a high band portion of the audio signal. The method further includes encoding a second frame of the audio signal using a second encoder, where encoding the second frame includes processing the baseband signal to generate high band parameters associated with the second frame.

In another particular aspect, a method includes decoding, at a device that includes a first decoder and a second decoder, a first frame of an audio signal using the second decoder. The second decoder generates overlap data corresponding to a beginning portion of a second frame of the audio signal. The method also includes decoding the second frame using the first decoder. Decoding the second frame includes applying a smoothing operation using the overlap data from the second decoder.

In another particular aspect, an apparatus includes a first encoder configured to encode a first frame of an audio signal and to generate, during encoding of the first frame, a baseband signal that includes content corresponding to a high band portion of the audio signal. The apparatus also includes a second encoder configured to encode a second frame of the audio signal. Encoding the second frame includes processing the baseband signal to generate high band parameters associated with the second frame.

In another particular aspect, an apparatus includes a first encoder configured to encode a first frame of an audio signal. The apparatus also includes a second encoder configured to, during encoding of a second frame of the audio signal, estimate a first portion of the first frame. The second encoder is also configured to populate a buffer of the second encoder based on the first portion of the first frame and the second frame and to generate high band parameters associated with the second frame.

In another particular aspect, an apparatus includes a first decoder and a second decoder. The second decoder is configured to decode a first frame of an audio signal and to generate overlap data corresponding to a portion of a second frame of the audio signal. The first decoder is configured to, during decoding of the second frame, apply a smoothing operation using the overlap data from the second decoder.

In another particular aspect, a computer-readable storage device stores instructions that, when executed by a processor, cause the processor to perform operations including encoding a first frame of an audio signal using a first encoder. The operations also include generating, during encoding of the first frame, a baseband signal that includes content corresponding to a high band portion of the audio signal. The operations further include encoding a second frame of the audio signal using a second encoder. Encoding the second frame includes processing the baseband signal to generate high band parameters associated with the second frame.

Particular advantages provided by at least one of the disclosed examples include an ability to reduce frame boundary artifacts and energy mismatches when switching between encoders or decoders at a device. For example, one or more memories, such as buffers or filter states of one encoder or decoder may be determined based on operation of another encoder or decoder. Other aspects, advantages, and features of the present disclosure will become apparent after review of the entire application, including the following sections: Brief Description of the Drawings, Detailed Description, and the Claims.

V. BRIEF DESCRIPTION OF THE DRAWINGS

VI. DETAILED DESCRIPTION

Figure 1:
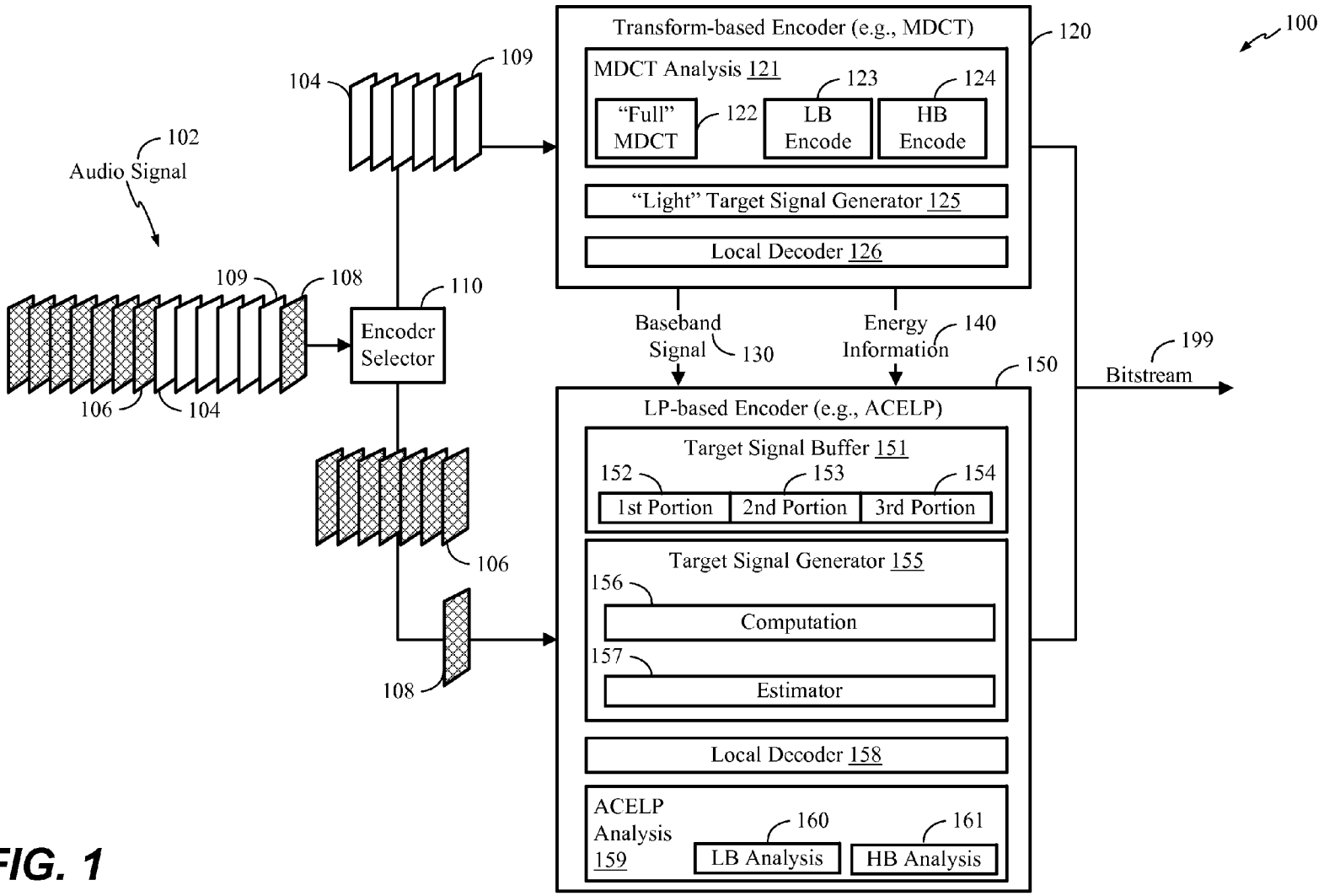
FIG. 1 is a block diagram to illustrate a particular example of a system that is operable to support switching between encoders with reduction in frame boundary artifacts and energy mismatches.

Referring to FIG. 1, a particular example of a system that is operable to switch encoders (e.g., encoding technologies) while reducing frame boundary artifacts and energy mismatches is depicted and generally designated 100. In an illustrative example, the system 100 is integrated into an electronic device, such as a wireless telephone, a tablet computer, etc. The system 100 includes an encoder selector 110, a transform-based encoder (e.g., an MDCT encoder 120), and an LP-based encoder (e.g., an ACELP encoder 150). In an alternate example, different types of encoding technologies may be implemented in the system 100.

In the following description, various functions performed by the system 100 of FIG. 1 are described as being performed by certain components or modules. However, this division of components and modules is for illustration only. In an alternate example, a function performed by a particular component or module may instead be divided amongst multiple components or modules. Moreover, in an alternate example, two or more components or modules of FIG. 1 may be integrated into a single component or module. Each component or module illustrated in FIG. 1 may be implemented using hardware (e.g., an application-specific integrated circuit (ASIC), a digital signal processor (DSP), a controller, a field-programmable gate array (FPGA) device, etc.), software (e.g., instructions executable by a processor), or any combination thereof.

In addition, it should be noted that although FIG. 1 illustrates a separate MDCT encoder 120 and ACELP encoder 150, this is not to be considered limiting. In alternate examples, a single encoder of an electronic device can include components corresponding to the MDCT encoder 120 and the ACELP encoder 150. For example, the encoder can include one or more low band (LB) "core" modules (e.g., a MDCT core and an ACELP core) and one or more high band (HB)/BWE modules. A low band portion of each frame of the audio signal 102 may be provided to a particular low band core module for encoding, depending characteristics of the frame (e.g., whether the frame contains speech, noise, music, etc.). The high band portion of each frame may be provided to a particular HB/BWE module.

The encoder selector 110 may be configured to receive an audio signal 102. The audio signal 102 may include speech data, non-speech data (e.g., music or background noise), or both. In an illustrative example, the audio signal 102 is an SWB signal. For example, the audio signal 102 may occupy a frequency range spanning approximately 0 Hz to 16 kHz. The audio signal 102 may include a plurality of frames, where each frame has a particular duration. In an illustrative example, each frame is 20 ms in duration, although in alternate examples different frame durations may be used. The encoder selector 110 may determine whether each frame of the audio signal 102 is to be encoded by the MDCT encoder 120 or the ACELP encoder 150. For example, the encoder selector 110 may classify frames of the audio signal 102 based on spectral analysis of the frames. In a particular example, the encoder selector 110 sends frames that include substantial high-frequency components to the MDCT encoder 120. For example, such frames may include background noise, noisy speech, or music signals. The encoder selector 110 may send frames that do not include substantial high-frequency components to the ACELP encoder 150. For example, such frames may include speech signals.

Thus, during operation of the system 100, encoding of the audio signal 102 may switch from the MDCT encoder 120 to the ACELP encoder 150, and vice versa. The MDCT encoder 120 and the ACELP encoder 150 may generate an output bit stream 199 corresponding to the encoded frames. For ease of illustration, frames that are to be encoded by the ACELP encoder 150 are shown with a crosshatched pattern and frames that are to be encoded by the MDCT encoder 120 are shown without a pattern. In the example of FIG. 1, a switch from ACELP encoding to MDCT encoding occurs at a frame boundary between frames 108 and 109. A switch from MDCT encoding to ACELP encoding occurs at a frame boundary between a frames 104 and 106.

The MDCT encoder 120 includes a MDCT analysis module 121 that performs encoding in the frequency domain. If the MDCT encoder 120 does not perform BWE, the MDCT analysis module 121 may include a "full" MDCT module 122. The "full" MDCT module 122 may encode frames of the audio signal 102 based on analysis of an entire frequency range of the audio signal 102 (e.g., 0 Hz-16 kHz). Alternately, if the MDCT encoder 120 performs BWE, LB data and high HB data may be processed separately. A low band module 123 may generate an encoded representation of a low band portion of the audio signal 102, and a high band module 124 may generate high band parameters that are to be used by a decoder to reconstruct a high band portion (e.g., 8 kHz-16 kHz) of the audio signal 102. The MDCT encoder 120 may also include a local decoder 126 for closed loop estimation. In an illustrative example, the local decoder 126 is used to synthesize a representation of the audio signal 102 (or a portion thereof, such as a high band portion).

The synthesized signal may be stored in a synthesis buffer and may be used by the high band module 124 during determination of the high band parameters.

The ACELP encoder 150 may include a time domain ACELP analysis module 159. In the example of FIG. 1, the ACELP encoder 150 performs bandwidth extension and includes a low band analysis module 160 and a separate high band analysis module 161. The low band analysis module 160 may encode a low band portion of the audio signal 102. In an illustrative example, the low band portion of the audio signal 102 occupies a frequency range spanning approximately 0 Hz-6.4 kHz. In alternate examples, a different crossover frequency may separate the low band and the high band portions and/or the portions may overlap, as further described with reference to FIG. 2. In a particular example, the low band analysis module 160 encodes the low band portion of the audio signal 102 by quantizing LSPs that are generated from an LP analysis of the low band portion. The quantization may be based on a low band codebook. ACELP low band analysis is further described with reference to FIG. 2.

A target signal generator 155 of the ACELP encoder 150 may generate a target signal that corresponds to a baseband version of the high band portion of the audio signal 102. To illustrate, a computation module 156 may generate the target signal by perform one or more flip, decimation, high-order filtering, downmixing, and/or downsampling operations on the audio signal 102. As the target signal is generated, the target signal may be used to populate a target signal buffer 151. In a particular example, the target signal buffer 151 stores 1.5 frames worth of data and includes a first portion 152, a second portion 153, and a third portion 154. Thus, when frames are 20 ms in duration, the target signal buffer 151 represents high band data for 30 ms of the audio signal.

The first portion 152 may represent high band data in 1-10 ms, the second portion 153 may represent high band data in 11-20 ms, and the third portion 154 may represent high band data in 21-30 ms.

The high band analysis module 161 may generate high band parameters that can be used by a decoder to reconstruct a high band portion of the audio signal 102. For example, the high band portion of the audio signal 102 may occupy the frequency range spanning approximately 6.4 kHz-16 kHz. In an illustrative example, the high band analysis module 161 quantizes (e.g., based on a codebook) LSPs that are generated from LP analysis of the high band portion. The high band analysis module 161 may also receive a low band excitation signal from the low band analysis module 160. The high band analysis module 161 may generate a high band excitation signal from the low band excitation signal. The high band excitation signal may be provided to a local decoder 158, which generates a synthesized high band portion. The high band analysis module 161 may determine the high band parameters, such as frame gain, gain factor, etc., based on the high band target in the target signal buffer 151 and/or the synthesized high band portion from the local decoder 158. ACELP high band analysis is further described with reference to FIG. 2.

After encoding of the audio signal 102 switches from the MDCT encoder 120 to the ACELP encoder 150 at the frame boundary between the frames 104 and 106, the target signal buffer 151 may be empty, may be reset, or may include high band data from several frames in the past (e.g., the frame 108). Further, filter states in the ACELP encoder, such as filter states of filters in the computation module 156, the LB analysis module 160, and/or the HB analysis module 161, may reflect operation from several frames in the past. If such reset or "outdated" information is used during ACELP encoding, annoying artifacts (e.g., clicking sounds) may be generated at the frame boundary between the first frame 104 and the second frame 106. Further, an energy mismatch may be perceived by a listener (e.g., a sudden increase or decrease in volume or other audio characteristic). In accordance with the described techniques, instead of resetting or using old filter states and target data, the target signal buffer 151 may be populated and filter states may be determined based on data associated with the first frame 104 (i.e., the last frame encoded by the MDCT encoder 120 prior to the switch to the ACELP encoder 150).

In a particular aspect, the target signal buffer 151 is populated based on a "light" target signal generated by the MDCT encoder 120. For example, the MDCT encoder 120 may include a "light" target signal generator 125. The "light" target signal generator 125 may generate a baseband signal 130 that represents an estimate of a target signal to be used by the ACELP encoder 150. In a particular aspect, the baseband signal 130 is generated by performing a flip operation and a decimation operation on the audio signal 102. In one example, the "light" target signal generator 125 runs continuously during operation of the MDCT encoder 120. To reduce computational complexity, the "light" target signal generator 125 may generate the baseband signal 130 without performing a high-order filtering operation or a downmixing operation. The baseband signal 130 may be used to populate at least a portion of the target signal buffer 151. For example, the first portion 152 may be populated based on the baseband signal 130, and the second portion 153 and the third portion 154 may be populated based on a high band portion of the 20 ms represented by the second frame 106.

In a particular example, a portion of the target signal buffer 151 (e.g., the first portion 152) may be populated based on an output of the MDCT local decoder 126 (e.g., a most recent 10 ms of synthesized output) instead of an output of the "light" target signal generator 125. In this example, the baseband signal 130 may correspond to a synthesized version of the audio signal 102. To illustrate, the baseband signal 130 may be generated from a synthesis buffer of the MDCT local decoder 126. If the MDCT analysis module 121 does a "full" MDCT, the local decoder 126 may perform a "full" inverse MDCT (IMDCT) (0 Hz-16 kHz), and the baseband signal 130 may correspond to a high band portion of the audio signal 102 as well as an additional portion (e.g., a low band portion) of the audio signal. In this example, the synthesis output and/or the baseband signal 130 may be filtered (e.g., via a high-pass filter (HPF), a flip and decimation operation, etc.) to generate a result signal that approximates (e.g., includes) high band data (e.g., in the 8 kHz-16 kHz band).

If the MDCT encoder 120 performs BWE, the local decoder 126 may include a high band IMDCT (8 kHz-16 kHz) to synthesize a high band-only signal. In this example, the baseband signal 130 may represent the synthesized high band-only signal and may be copied into the first portion 152 of the target signal buffer 151. In this example, the first portion 152 of the target signal buffer 151 is populated without using filtering operations, but rather only a data copying operation. The second portion 153 and the third portion 154 of the target signal buffer 151 may be populated based on a high band portion of the 20 ms represented by the second frame 106.

Thus, in certain aspects, the target signal buffer 151 may be populated based on the baseband signal 130, which represents target or synthesized signal data that would have been generated by the target signal generator 155 or the local decoder 158 if the first frame 104 had been encoded by the ACELP encoder 150 instead of the MDCT encoder 120. Other memory elements, such as filter states (e.g., LP filter states, decimator states, etc.) in the ACELP encoder 150, may also be determined based on the baseband signal 130 instead of being reset in response to an encoder switch. By using an approximation of target or synthesized signal data, frame boundary artifacts and energy mismatches may be reduced as compared to resetting the target signal buffer 151. In addition, filters in the ACELP encoder 150 may reach a "stationary" state (e.g., converge) faster.

In a particular aspect, data corresponding to the first frame 104 may be estimated by the ACELP encoder 150. For example, the target signal generator 155 may include an estimator 157 configured to estimate a portion of the first frame 104 to populate a portion of the target signal buffer 151. In a particular aspect, the estimator 157 performs an extrapolation operation based on data of the second frame 106. For example, data representing a high band portion of the second frame 106 may be stored in the second and third portions 153, 154 of the target signal buffer 151. The estimator 157 may store data in the first portion 152 that is generated by extrapolating (alternately referred to as "back-propagating") the data stored in the second portion 153, and optionally the third portion 154. As another example, the estimator 157 may perform a backward LP based on the second frame 106 to estimate the first frame 104 or a portion thereof (e.g., a last 10 ms or 5 ms of the first frame 104).

In a particular aspect, the estimator 157 estimates the portion of the first frame 104 based on energy information 140 indicating an energy associated with the first frame 104. For example, the portion of the first frame 104 may be estimated based on an energy associated with a locally decoded (e.g., at the MDCT local decoder 126) low band portion of the first frame 104, a locally decoded (e.g., at the MDCT local decoder 126) high band portion of the first frame 104, or both. By taking the energy information 140 into account, the estimator 157 may help reduce energy mismatches at frame boundaries, such as dips in gain shape, when switching from the MDCT encoder 120 to the ACELP encoder 150. In an illustrative example, the energy information 140 is determined based on an energy associated with a buffer in the MDCT encoder, such as the MDCT synthesis buffer. An energy of the entire frequency range of synthesis buffer (e.g., 0 Hz-16 kHz) or an energy of only the high band portion of the synthesis buffer (e.g., 8 kHz-16 kHz) may be used by the estimator 157. The estimator 157 may apply a tapering operation on the data in the first portion 152 based on the estimated energy of the first frame 104. Tapering may reduce energy mismatches at frame boundaries, such as in cases when a transition between an "inactive" or low energy frame and an "active" or high energy frame occurs. The tapering applied by the estimator 157 to the first portion 152 may be linear or may be based on another mathematical function.

In a particular aspect, the estimator 157 estimates the portion of the first frame 104 based at least in part on a frame type of the first frame 104. For example, the estimator 157 may estimate the portion of the first frame 104 based on the frame type of the first frame 104 and/or a frame type of the second frame 106 (alternately referred to as a "coding type"). Frame types may include a voiced frame type, an unvoiced frame type, a transient frame type, and a generic frame type. Depending on the frame type(s), the estimator 157 may apply a different tapering operation (e.g., use different tapering coefficients) on the data in the first portion 152.

Thus, in certain aspects, the target signal buffer 151 may be populated based on a signal estimate and/or energy associated with the first frame 104 or a portion thereof. Alternately, or in addition, a frame type of the first frame 104 and/or the second frame 106 may be used during the estimation process, such as for signal tapering. Other memory elements, such as filter states (e.g., LP filter states, decimator states, etc.) in the ACELP encoder 150, may also be determined based on the estimation instead of being reset in response to an encoder switch, which may enable the filter states to reach a "stationary" state (e.g., converge) faster.

The system 100 of FIG. 1 may handle memory updates when switching between a first encoding mode or encoder (e.g., the MDCT encoder 120) and a second encoding mode or encoder (e.g., the ACELP encoder 150) in a way that reduces frame boundary artifacts and energy mismatches. Use of the system 100 of FIG. 1 may lead to improved signal coding quality as well as improved user experience.

Figure 2:
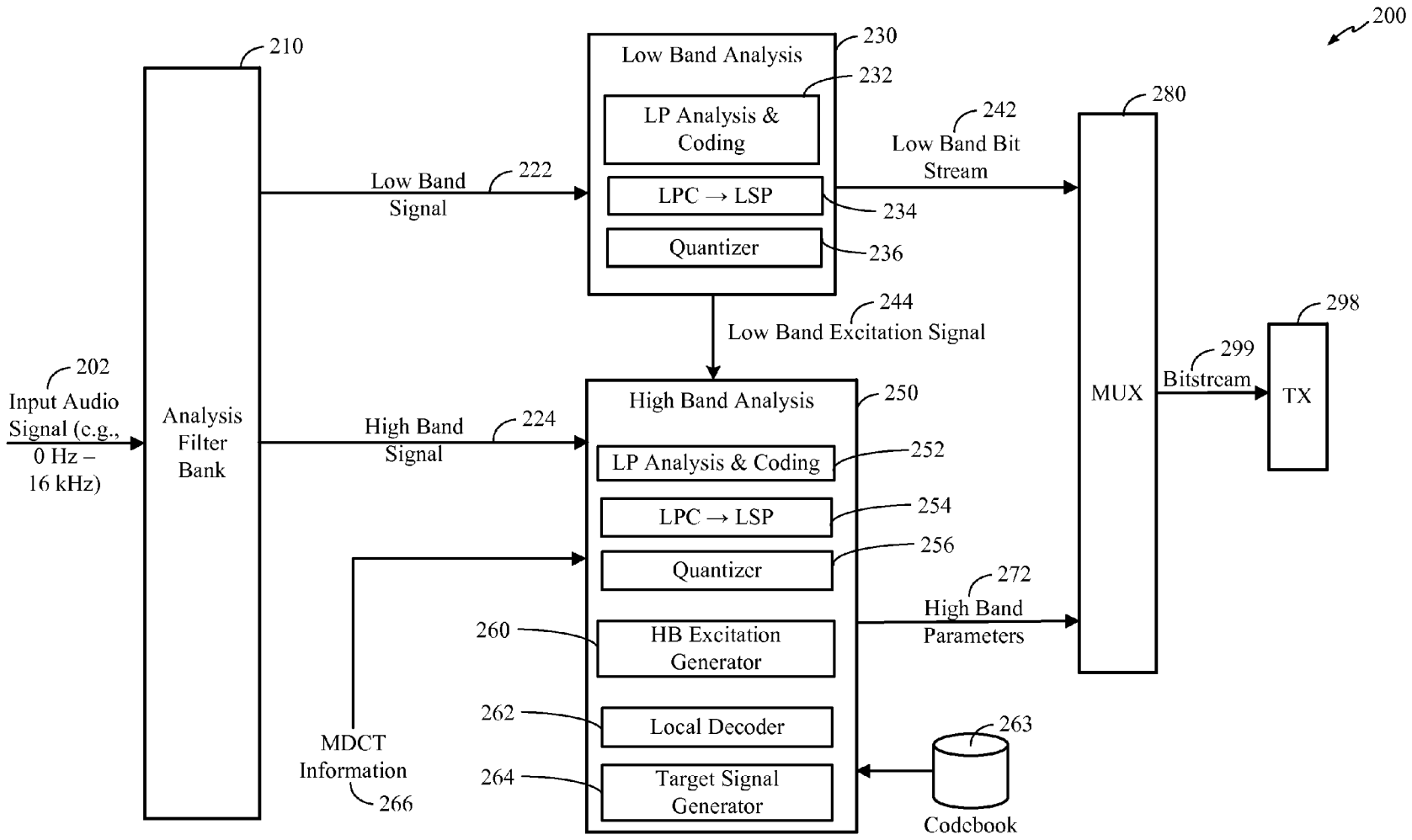
FIG. 2 is a block diagram to illustrate a particular example of an ACELP encoding system.

Referring to FIG. 2, a particular example of an ACELP encoding system 200 is depicted and generally designated 200. One or more components of the system 200 may correspond to one or more components of the system 100 of FIG. 1, as further described herein. In an illustrative example, the system 200 is integrated into an electronic device, such as a wireless telephone, a tablet computer, etc.

In the following description, various functions performed by the system 200 of FIG. 2 are described as being performed by certain components or modules. However, this division of components and modules is for illustration only. In an alternate example, a function performed by a particular component or module may instead be divided amongst multiple components or modules. Moreover, in an alternate example, two or more components or modules of FIG. 2 may be integrated into a single component or module. Each component or module illustrated in FIG. 2 may be implemented using hardware (e.g., an ASIC, a DSP, a controller, an FPGA device, etc.), software (e.g., instructions executable by a processor), or any combination thereof.

The system 200 includes an analysis filter bank 210 that is configured to receive an input audio signal 202. For example, the input audio signal 202 may be provided by a microphone or other input device. In an illustrative example, the input audio signal 202 may correspond to the audio signal 102 of FIG. 1 when the encoder selector 110 of FIG. 1 determines that the audio signal 102 is to be encoded by the ACELP encoder 150 of FIG. 1. The input audio signal 202 may be a super wideband (SWB) signal that includes data in the frequency range from approximately 0 Hz-16 kHz. The analysis filter bank 210 may filter the input audio signal 202 into multiple portions based on frequency. For example, the analysis filter bank 210 may include a low pass filter (LPF) and a high pass filter (HPF) to generate a low band signal 222 and a high band signal 224. The low band signal 222 and the high band signal 224 may have equal or unequal bandwidths, and may be overlapping or non-overlapping. When the low band signal 222 and the high band signal 224 overlap, the low pass filter and the high pass filter of the analysis filter bank 210 may have a smooth rolloff, which may simplify design and reduce cost of the low pass filter and the high pass filter. Overlapping the low band signal 222 and the high band signal 224 may also enable smooth blending of low band and high band signals at a receiver, which may result in fewer audible artifacts.

It should be noted that although certain examples are described herein in the context of processing a SWB signal, this is for illustration only. In an alternate example, the described techniques may be used to process a WB signal having a frequency range of approximately 0 Hz-8 kHz. In such an example, the low band signal 222 may correspond to a frequency range of approximately 0 Hz-6.4 kHz and the high band signal 224 may correspond to a frequency range of approximately 6.4 kHz-8 kHz.

The system 200 may include a low band analysis module 230 configured to receive the low band signal 222. In a particular aspect, the low band analysis module 230 may represent an example of an ACELP encoder. For example, the low band analysis module 230 may correspond to the low band analysis module 160 of FIG. 1. The low band analysis module 230 may include an LP analysis and coding module 232, a linear prediction coefficient (LPC) to line spectral pair (LSP) transform module 234, and a quantizer 236. LSPs may also be referred to as LSFs, and the two terms may be used interchangeably herein. The LP analysis and coding module 232 may encode a spectral envelope of the low band signal 222 as a set of LPCs. LPCs may be generated for each frame of audio (e.g., 20 ms of audio, corresponding to 320 samples at a sampling rate of 16 kHz), each sub-frame of audio (e.g., 5 ms of audio), or any combination thereof. The number of LPCs generated for each frame or sub-frame may be determined by the "order" of the LP analysis performed. In a particular aspect, the LP analysis and coding module 232 may generate a set of eleven LPCs corresponding to a tenth-order LP analysis.

The transform module 234 may transform the set of LPCs generated by the LP analysis and coding module 232 into a corresponding set of LSPs (e.g., using a one-to-one transform). Alternately, the set of LPCs may be one-to-one transformed into a corresponding set of parcor coefficients, log-area-ratio values, immittance spectral pairs (ISPs), or immittance spectral frequencies (ISFs). The transform between the set of LPCs and the set of LSPs may be reversible without error.

The quantizer 236 may quantize the set of LSPs generated by the transform module 234. For example, the quantizer 236 may include or be coupled to multiple codebooks that include multiple entries (e.g., vectors). To quantize the set of LSPs, the quantizer 236 may identify entries of codebooks that are "closest to" (e.g., based on a distortion measure such as least squares or mean square error) the set of LSPs. The quantizer 236 may output an index value or series of index values corresponding to the location of the identified entries in the codebooks. The output of the quantizer 236 may thus represent low band filter parameters that are included in a low band bit stream 242.

The low band analysis module 230 may also generate a low band excitation signal 244. For example, the low band excitation signal 244 may be an encoded signal that is generated by quantizing a LP residual signal that is generated during the LP process performed by the low band analysis module 230. The LP residual signal may represent prediction error.

The system 200 may further include a high band analysis module 250 configured to receive the high band signal 224 from the analysis filter bank 210 and the low band excitation signal 244 from the low band analysis module 230. For example, the high band analysis module 250 may correspond to the high band analysis module 161 of FIG. 1. The high band analysis module 250 may generate high band parameters 272 based on the high band signal 224 and the low band excitation signal 244. For example, the high band parameters 272 may include high band LSPs and/or gain information (e.g., based on at least a ratio of high band energy to low band energy), as further described herein.

The high band analysis module 250 may include a high band excitation generator 260. The high band excitation generator 260 may generate a high band excitation signal by extending a spectrum of the low band excitation signal 244 into the high band frequency range (e.g., 8 kHz-16 kHz). The high band excitation signal may be used to determine one or more high band gain parameters that are included in the high band parameters 272. As illustrated, the high band analysis module 250 may also include an LP analysis and coding module 252, a LPC to LSP transform module 254, and a quantizer 256. Each of the LP analysis and coding module 252, the transform module 254, and the quantizer 256 may function as described above with reference to corresponding components of the low band analysis module 230, but at a comparatively reduced resolution (e.g., using fewer bits for each coefficient, LSP, etc.). The LP analysis and coding module 252 may generate a set of LPCs that are transformed to LSPs by the transform module 254 and quantized by the quantizer 256 based on a codebook 263. For example, the LP analysis and coding module 252, the transform module 254, and the quantizer 256 may use the high band signal 224 to determine high band filter information (e.g., high band LSPs) that is included in the high band parameters 272. In a particular aspect, the high band parameters 272 may include high band LSPs as well as high band gain parameters.

The high band analysis module 250 may also include a local decoder 262 and a target signal generator 264. For example, the local decoder 262 may correspond to the local decoder 158 of FIG. 1 and the target signal generator 264 may correspond to the target signal generator 155 of FIG. 1. The high band analysis module 250 may further receive MDCT information 266 from a MDCT encoder. For example, the MDCT information 266 may include the baseband signal 130 of FIG. 1 and/or the energy information 140 of FIG. 1, and may be used to reduce frame boundary artifacts and energy mismatches when switching from MDCT encoding to ACELP encoding performed by the system 200 of FIG. 2.

The low band bit stream 242 and the high band parameters 272 may be multiplexed by a multiplexer (MUX) 280 to generate an output bit stream 299. The output bit stream 299 may represent an encoded audio signal corresponding to the input audio signal 202. For example, the output bit stream 299 may be transmitted by a transmitter 298 (e.g., over a wired, wireless, or optical channel) and/or stored. At a receiver device, reverse operations may be performed by a demultiplexer (DEMUX), a low band decoder, a high band decoder, and a filter bank to generate an synthesized audio signal (e.g., a reconstructed version of the input audio signal 202 that is provided to a speaker or other output device). The number of bits used to represent the low band bit stream 242 may be substantially larger than the number of bits used to represent the high band parameters 272. Thus, most of the bits in the output bit stream 299 may represent low band data. The high band parameters 272 may be used at a receiver to regenerate the high band excitation signal from the low band data in accordance with a signal model. For example, the signal model may represent an expected set of relationships or correlations between low band data (e.g., the low band signal 222) and high band data (e.g., the high band signal 224). Thus, different signal models may be used for different kinds of audio data, and the particular signal model that is in use may be negotiated by a transmitter and a receiver (or defined by an industry standard) prior to communication of encoded audio data. Using the signal model, the high band analysis module 250 at a transmitter may be able to generate the high band parameters 272 such that a corresponding high band analysis module at a receiver is able to use the signal model to reconstruct the high band signal 224 from the output bit stream 299.

FIG. 2 thus illustrates an ACELP encoding system 200 that uses MDCT information 266 from a MDCT encoder when encoding the input audio signal 202. By using the MDCT information 266, frame boundary artifacts and energy mismatches may be reduced. For example, the MDCT information 266 may be used to perform target signal estimation, backpropagating, tapering, etc.

Figure 3:
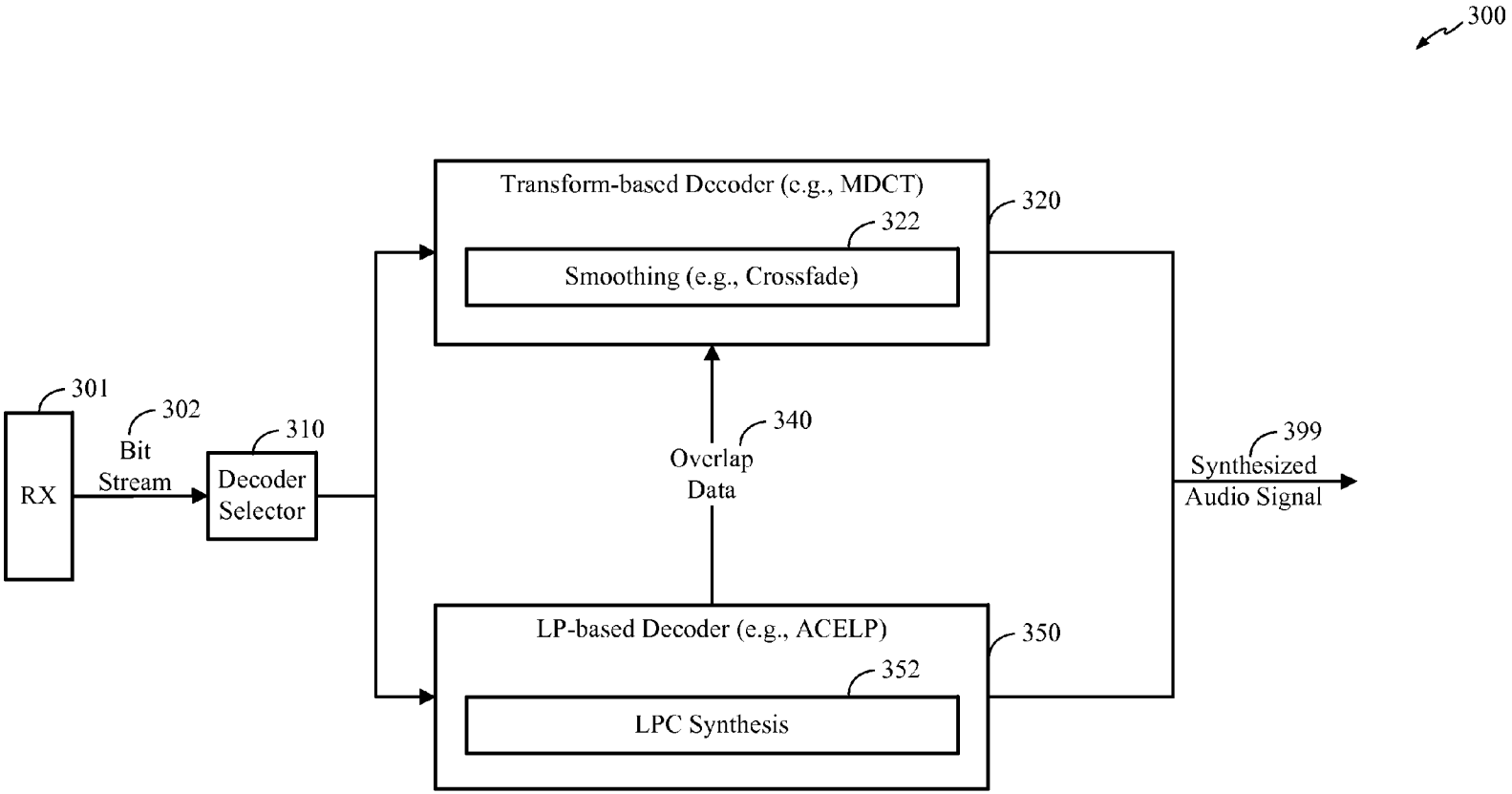
FIG. 3 is a block diagram to illustrate a particular example of a system that is operable to support switching between decoders with reduction in frame boundary artifacts and energy mismatches.

Referring to FIG. 3, a particular example of a system that is operable to support switching between decoders with reduction in frame boundary artifacts and energy mismatches is shown and generally designated 300. In an illustrative example, the system 300 is integrated into an electronic device, such as a wireless telephone, a tablet computer, etc.

The system 300 includes receiver 301, a decoder selector 310, a transformed-based decoder (e.g., a MDCT decoder 320), and a LP-based decoder (e.g., an ACELP decoder 350). Thus, although not shown, the MDCT decoder 320 and the ACELP decoder 350 may include one or more components that perform inverse operations to those described with reference to one or more components of the MDCT encoder 120 of FIG. 1 and the ACELP encoder 150 of FIG. 1, respectively. Further, one or more operations described as being performed by the MDCT decoder 320 may also be performed by the MDCT local decoder 126 of FIG. 1, and one or more operations described as being performed by the ACELP decoder 350 may also be performed by the ACELP local decoder 158 of FIG. 1.

During operation, a receiver 301 may receive and provide a bit stream 302 to a decoder selector 310. In an illustrative example, the bit stream 302 corresponds to the output bit stream 199 of FIG. 1 or the output bit stream 299 of FIG. 2. The decoder selector 310 may determine, based on characteristics of the bit stream 302, whether the MDCT decoder 320 or the ACELP decoder 350 is to be used to decode the bit stream 302 to generate a synthesized audio signal 399.

When the ACELP decoder 350 is selected, a LPC synthesis module 352 may process the bit stream 302, or a portion thereof. For example, the LPC synthesis module 352 may decode data corresponding to a first frame of an audio signal. During the decoding, the LPC synthesis module 352 may generate overlap data 340 corresponding to a second (e.g., next) frame of the audio signal. In an illustrative example, the overlap data 340 may include 20 audio samples.

When the decoder selector 310 switches decoding from the ACELP decoder 350 to the MDCT decoder 320, a smoothing module 322 may use the overlap data 340 to perform a smoothing function. The smoothing function may smooth a frame boundary discontinuity due to resetting of filter memories and synthesis buffers in the MDCT decoder 320 in response to the switch from the ACELP decoder 350 to the MDCT decoder 320. As an illustrative, non-limiting example, the smoothing module 322 may perform a cross-fade operation based on the overlap data 340, so that a transition between synthesized output based on the overlap data 340 and synthesized output for the second frame of the audio signal is perceived by a listener to be more continuous.

The system 300 of FIG. 3 may thus handle filter memory and buffer updates when switching between a first decoding mode or decoder (e.g., the ACELP decoder 350) and a second decoding mode or decoder (e.g., the MDCT decoder 320) in a way that reduces frame boundary discontinuity. Use of the system 300 of FIG. 3 may lead to improved signal reconstruction quality, as well as improved user experience.

One or more of the systems of FIGS. 1-3 may thus modify filter memories and lookahead buffers and backward predict frame boundary audio samples of a "previous" core's synthesis for combination with a "current" core's synthesis. For example, instead of resetting an ACELP lookahead buffer to zero, content in the buffer may be predicted from a MDCT "light" target or synthesis buffer, as described with reference to FIG. 1. Alternatively, backward prediction of the frame boundary samples may be done, as described with reference to FIGS. 1-2. Additional information, such as MDCT energy information (e.g., the energy information 140 of FIG. 1), frame type, etc., may optionally be used. Further, to limit temporal discontinuities, certain synthesis output, such as ACELP overlap samples, can be smoothly mixed at the frame boundary during MDCT decoding, as described with reference to FIG. 3. In a particular example, the last few samples of the "previous" synthesis can be used in calculation of frame gain and other bandwidth extension parameters.

Figure 4:
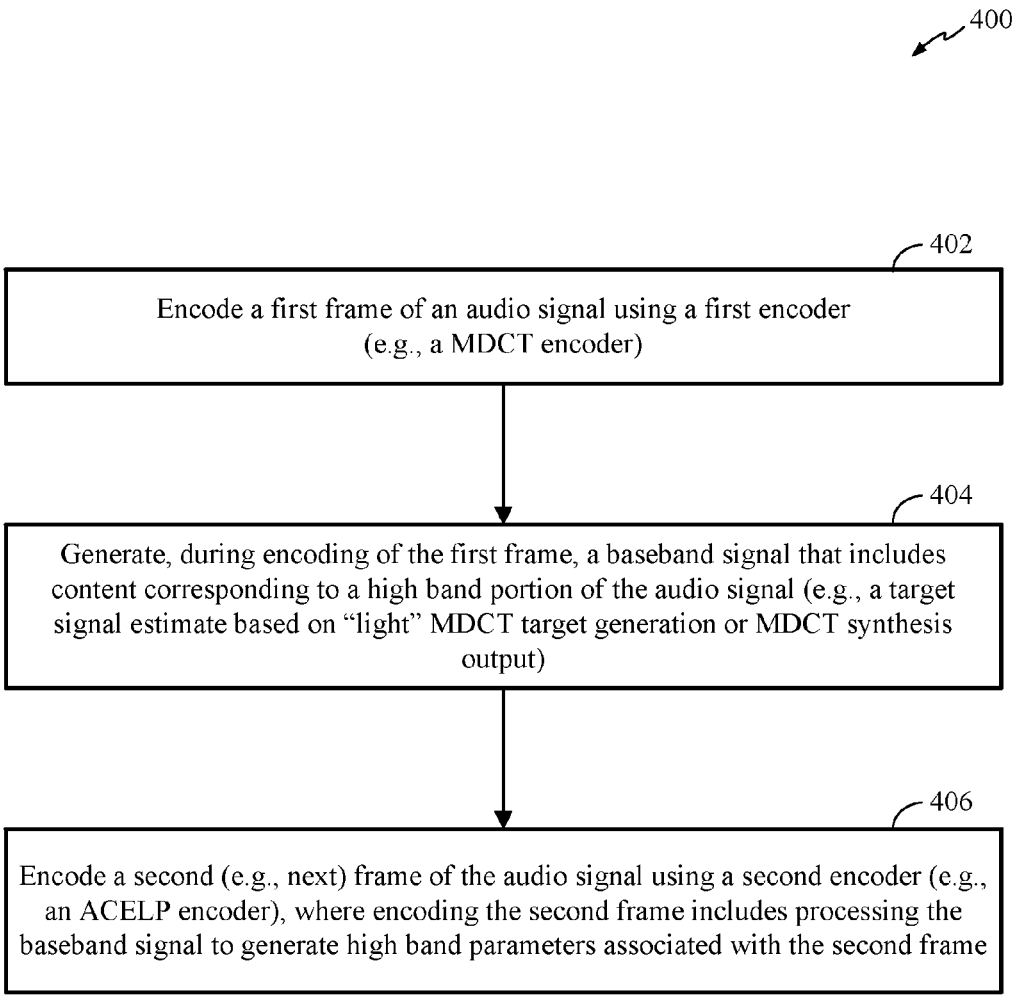
FIG. 4 is a flowchart to illustrate a particular example of a method of operation at an encoder device.

Referring to FIG. 4, a particular example of a method of operation at an encoder device is depicted and generally designated 400. In an illustrative example, the method 400 may be performed at the system 100 of FIG. 1.

The method 400 may include encoding a first frame of an audio signal using a first encoder, at 402. The first encoder may be a MDCT encoder. For example, in FIG. 1, the MDCT encoder 120 may encode the first frame 104 of the audio signal 102.

The method 400 may also include generating, during encoding of the first frame, a baseband signal that includes content corresponding to a high band portion of the audio signal, at 404. The baseband signal may correspond to a target signal estimate based on "light" MDCT target generation or MDCT synthesis output. For example, in FIG. 1, the MDCT encoder 120 may generate the baseband signal 130 based on a "light" target signal generated by the "light" target signal generator 125 or based on a synthesized output of the local decoder 126.

The method 400 may further include encoding a second (e.g., sequentially next) frame of the audio signal using a second encoder, at 406. The second encoder may be an ACELP encoder, and encoding the second frame may include processing the baseband signal to generate high band parameters associated with the second frame. For example, in FIG. 1, the ACELP encoder 150 may generate high band parameters based on processing of the baseband signal 130 to populate at least a portion of the target signal buffer 151. In an illustrative example, the high band parameters may be generated as described with reference to the high band parameters 272 of FIG. 2.

Figure 5:
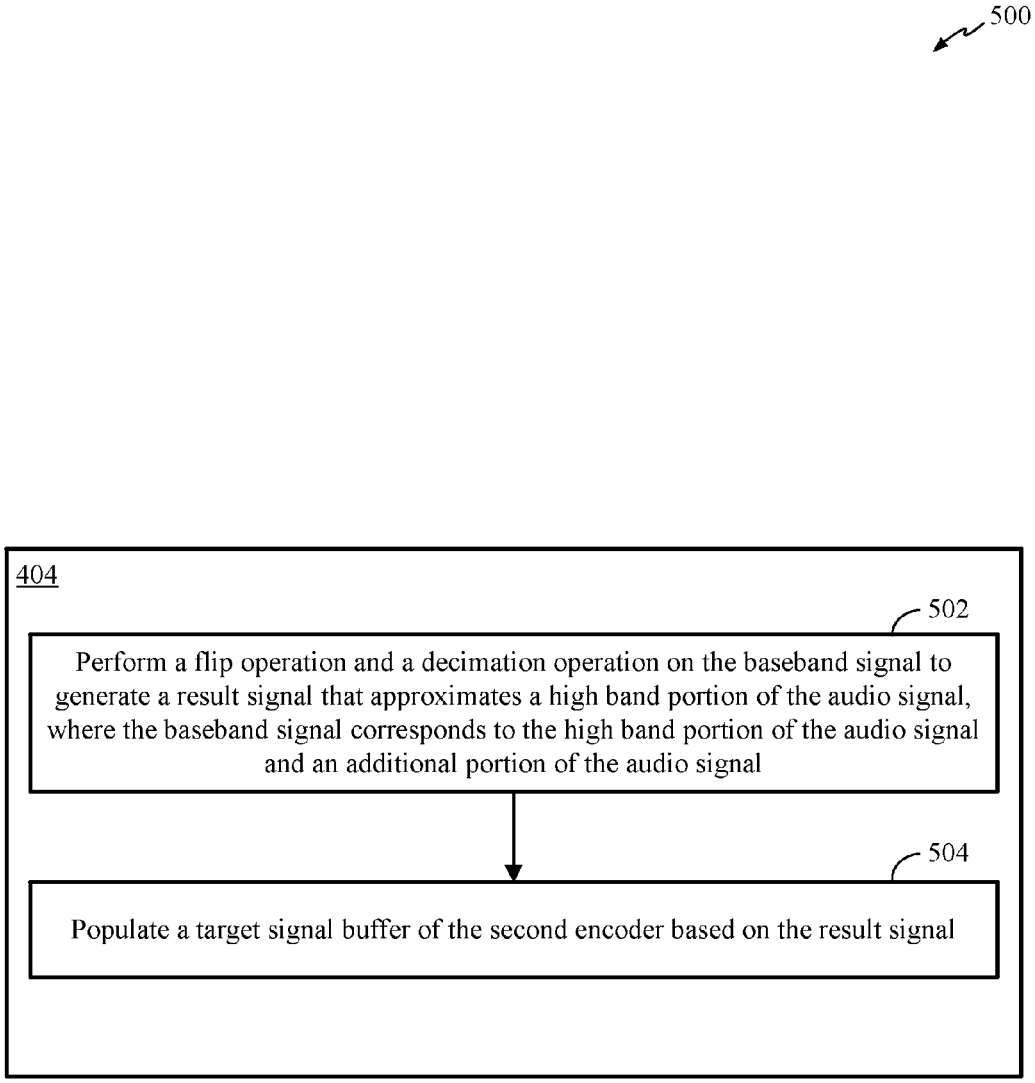
FIG. 5 is a flowchart to illustrate another particular example of a method of operation at an encoder device.

Referring to FIG. 5, another particular example of a method of operation at an encoder device is depicted and generally designated 500. The method 500 may be performed at the system 100 of FIG. 1. In a particular implementation, the method 500 may correspond to 404 of FIG. 4.

The method 500 includes performing a flip operation and a decimation operation on a baseband signal to generate a result signal that approximates a high band portion of an audio signal, at 502. The baseband signal may correspond to the high band portion of the audio signal and an additional portion of the audio signal. For example, the baseband signal 130 of FIG. 1 may be generated from a synthesis buffer of the MDCT local decoder 126, as described with reference to FIG. 1. To illustrate, the MDCT encoder 120 may generate the baseband signal 130 based on a synthesized output of the MDCT local decoder 126. The baseband signal 130 may correspond to a high band portion of the audio signal 120, as well as an additional (e.g., low band) portion of the audio signal 120. A flip operation and a decimation operation may be performed on the baseband signal 130 to generate a result signal that includes high band data, as described with reference to FIG. 1. For example, the ACELP encoder 150 may perform the flip operation and the decimation operation on the baseband signal 130 to generate a result signal.

The method 500 also includes populating a target signal buffer of the second encoder based on the result signal, at 504. For example, the target signal buffer 151 of the ACELP encoder 150 of FIG. 1 may be populated based on the result signal, as described with reference to FIG. 1. To illustrate, the ACELP encoder 150 may populate the target signal buffer 151 based on the result signal. The ACELP encoder 150 may generate a high band portion of the second frame 106 based on data stored in the target signal buffer 151, as described with reference to FIG. 1.

Figure 6:
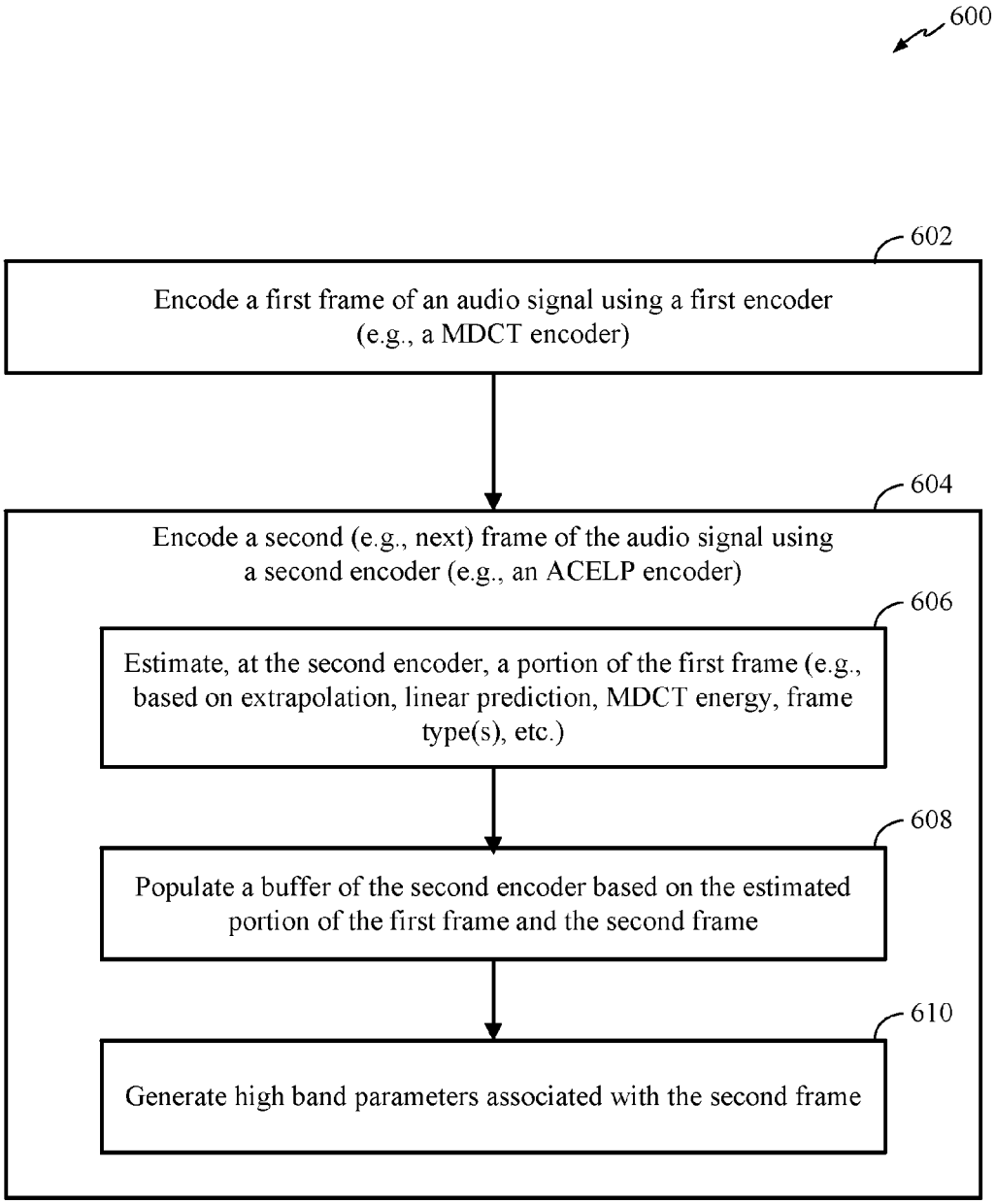
FIG. 6 is a flowchart to illustrate another particular example of a method of operation at an encoder device.

Referring to FIG. 6, another particular example of a method of operation at an encoder device is depicted and generally designated 600. In an illustrative example, the method 600 may be performed at the system 100 of FIG. 1.

The method 600 may include encoding a first frame of an audio signal using a first encoder, at 602, and encoding a second frame of the audio signal using a second encoder, at 604. The first encoder may be a MDCT encoder, such as the MDCT encoder 120 of FIG. 1, and the second encoder may be an ACELP encoder, such as the ACELP encoder 150 of FIG. 1. The second frame may sequentially follow the first frame.

Encoding the second frame may include estimating, at the second encoder, a first portion of the first frame, at 606. For example, referring to FIG. 1, the estimator 157 may estimate a portion (e.g., a last 10 ms) of the first frame 104 based on extrapolation, linear prediction, MDCT energy (e.g., the energy information 140), frame type(s), etc.

Encoding the second frame may also include populating a buffer of the second buffer based on the first portion of the first frame and the second frame, at 608. For example, referring to FIG. 1, the first portion 152 of the target signal buffer 151 may be populated based on the estimated portion of the first frame 104, and the second and third portions 153, 154 of the of the target signal buffer 151 may be populated based on the second frame 106.

Encoding the second frame may further include generating high band parameters associated with the second frame, at 610. For example, in FIG. 1, the ACELP encoder 150 may generate high band parameters associated with the second frame 106. In an illustrative example, the high band parameters may be generated as described with reference to the high band parameters 272 of FIG. 2.

Figure 7:
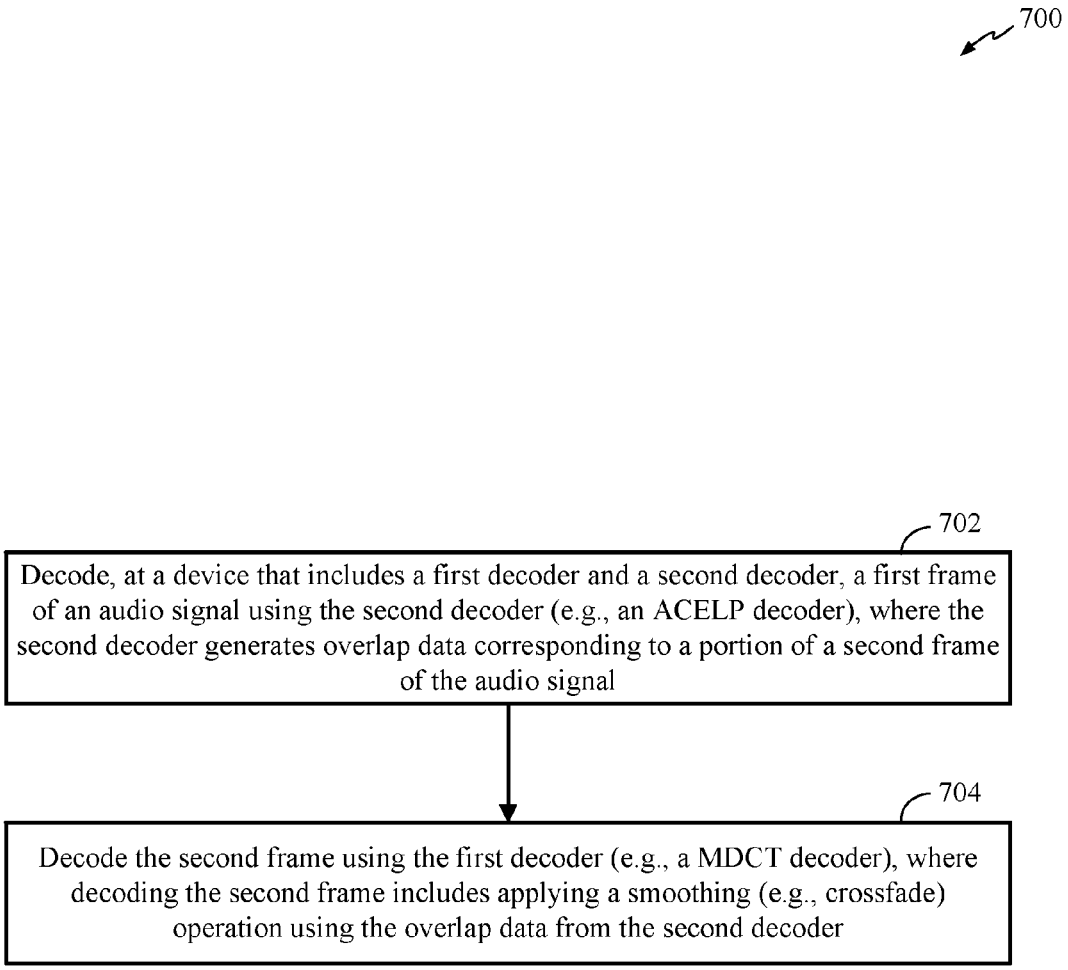
FIG. 7 is a flowchart to illustrate a particular example of a method of operation at a decoder device.

Referring to FIG. 7, a particular example of a method of operation at a decoder device is depicted and generally designated 700. In an illustrative example, the method 700 may be performed at the system 300 of FIG. 3.

The method 700 may include decoding, at a device that includes a first decoder and a second decoder, a first frame of an audio signal using the second decoder, at 702. The second decoder may be an ACELP decoder and may generate overlap data corresponding to a portion of a second frame of the audio signal. For example, referring to FIG. 3, the ACELP decoder 350 may decode a first frame and generate the overlap data 340 (e.g., 20 audio samples).

The method 700 may also include decoding the second frame using the first decoder, at 704. The first decoder may be a MDCT decoder, and decoding the second frame may include applying a smoothing (e.g., crossfade) operation using the overlap data from the second decoder. For example, referring to FIG. 1, the MDCT decoder 320 may decode a second frame and apply a smoothing operation using the overlap data 340.

In particular aspects, one or more of the methods FIGS. 4-7 may be implemented via hardware (e.g., an FPGA device, an ASIC, etc.) of a processing unit, such as a central processing unit (CPU), a DSP, or a controller, via a firmware device, or any combination thereof. As an example, one or more of the methods FIGS. 4-7 can be performed by a processor that executes instructions, as described with respect to FIG. 8.

Figure 8:
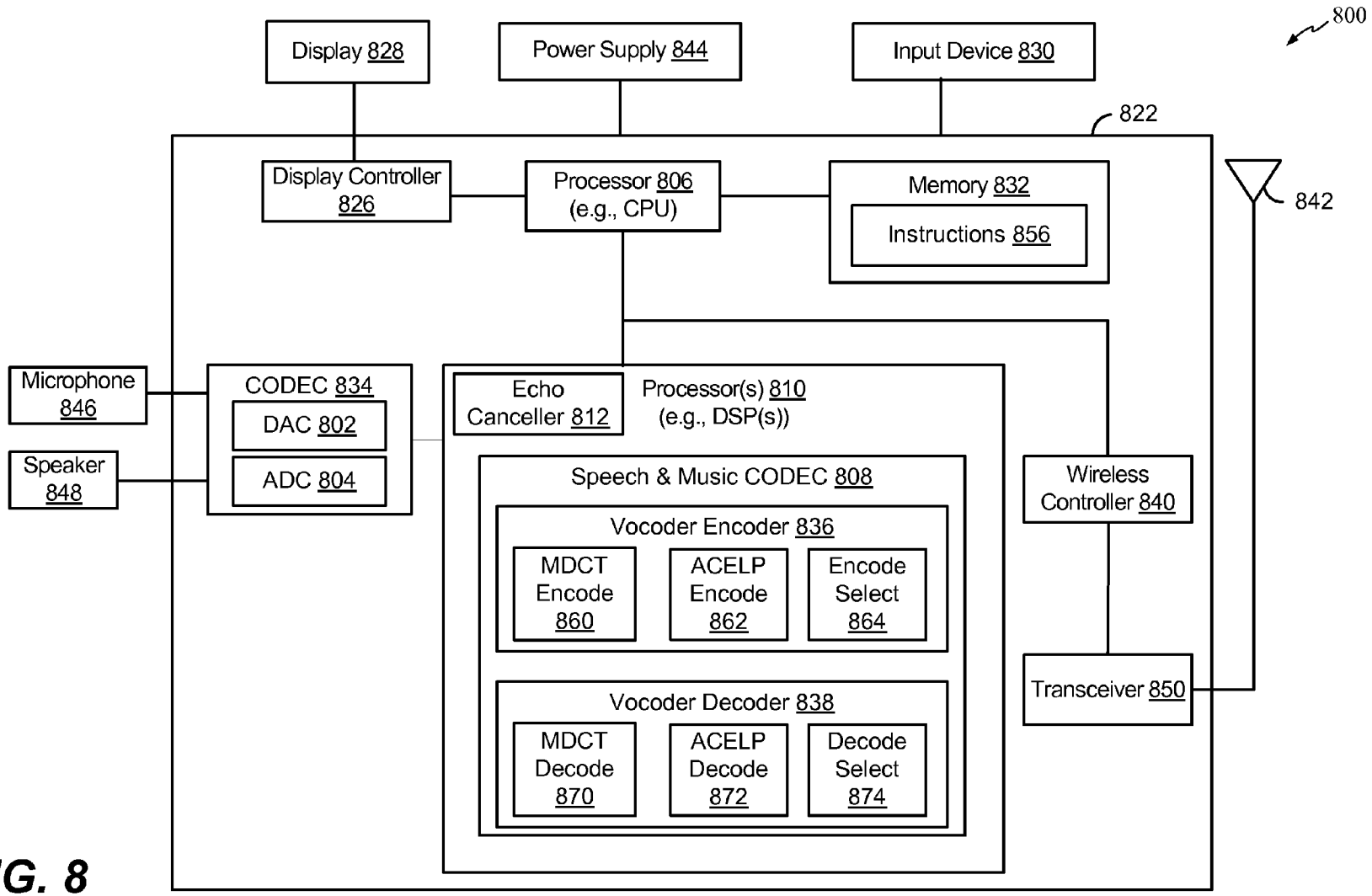
FIG. 8 is a block diagram of a wireless device operable to perform operations in accordance with the systems and methods of FIGS. 1-7.

Referring to FIG. 8, a block diagram of a particular illustrative example of a device (e.g., a wireless communication device) is depicted and generally designated 800. In various examples, the device 800 may have fewer or more components than illustrated in FIG. 8. In an illustrative example, the device 800 may correspond to one or more of the systems of FIGS. 1-3. In an illustrative example, the device 800 may operate according to one or more of the methods of FIGS. 4-7.

In a particular aspect, the device 800 includes a processor 806 (e.g., a CPU). The device 800 may include one or more additional processors 810 (e.g., one or more DSPs). The processors 810 may include a speech and music coder-decoder (CODEC) 808 and an echo canceller 812. The speech and music CODEC 808 may include a vocoder encoder 836, a vocoder decoder 838, or both.

In a particular aspect, the vocoder encoder 836 may include a MDCT encoder 860 and an ACELP encoder 862. The MDCT encoder 860 may correspond to the MDCT encoder 120 of FIG. 1, and the ACELP encoder 862 may correspond to the ACELP encoder 150 of FIG. 1 or one or more components of the ACELP encoding system 200 of FIG. 2. The vocoder encoder 836 may also include an encoder selector 864 (e.g., corresponding to the encoder selector 110 of FIG. 1). The vocoder decoder 838 may include a MDCT decoder 870 and an ACELP decoder 872. The MDCT decoder 870 may correspond to the MDCT decoder 320 of FIG. 3, and the ACELP decoder 872 may correspond to the ACELP decoder 350 of FIG. 1. The vocoder decoder 838 may also include a decoder selector 874 (e.g., corresponding to the decoder selector 310 of FIG. 3). Although the speech and music CODEC 808 is illustrated as a component of the processors 810, in other examples one or more components of the speech and music CODEC 808 may be included in the processor 806, the CODEC 834, another processing component, or a combination thereof.

The device 800 may include a memory 832 and a wireless controller 840 coupled to an antenna 842 via transceiver 850. The device 800 may include a display 828 coupled to a display controller 826. A speaker 848, a microphone 846, or both may be coupled to the CODEC 834. The CODEC 834 may include a digital-to-analog converter (DAC) 802 and an analog-to-digital converter (ADC) 804.

In a particular aspect, the CODEC 834 may receive analog signals from the microphone 846, convert the analog signals to digital signals using the analog-to-digital converter 804, and provide the digital signals to the speech and music CODEC 808, such as in a pulse code modulation (PCM) format. The speech and music CODEC 808 may process the digital signals. In a particular aspect, the speech and music CODEC 808 may provide digital signals to the CODEC 834. The CODEC 834 may convert the digital signals to analog signals using the digital-to-analog converter 802 and may provide the analog signals to the speaker 848.

The memory 832 may include instructions 856 executable by the processor 806, the processors 810, the CODEC 834, another processing unit of the device 800, or a combination thereof, to perform methods and processes disclosed herein, such as one or more of the methods of FIGS. 4-7. One or more components of the systems of FIGS. 1-3 may be implemented via dedicated hardware (e.g., circuitry), by a processor executing instructions (e.g., the instructions 856) to perform one or more tasks, or a combination thereof. As an example, the memory 832 or one or more components of the processor 806, the processors 810, and/or the CODEC 834 may be a memory device, such as a random access memory (RAM), magnetoresistive random access memory (MRAM), spin-torque transfer MRAM (STT-MRAM), flash memory, read-only memory (ROM), programmable read-only memory (PROM), erasable programmable read-only memory (EPROM), electrically erasable programmable read-only memory (EEPROM), registers, hard disk, a removable disk, or a compact disc read-only memory (CD-ROM). The memory device may include instructions (e.g., the instructions 856) that, when executed by a computer (e.g., a processor in the CODEC 834, the processor 806, and/or the processors 810), may cause the computer to perform at least a portion of one or more of the methods of FIGS. 4-7. As an example, the memory 832 or the one or more components of the processor 806, the processors 810, the CODEC 834 may be a non-transitory computer-readable medium that includes instructions (e.g., the instructions 856) that, when executed by a computer (e.g., a processor in the CODEC 834, the processor 806, and/or the processors 810), cause the computer perform at least a portion of one or more of the methods FIGS. 4-7.

In a particular aspect, the device 800 may be included in a system-in-package or system-on-chip device 822, such as a mobile station modem (MSM). In a particular aspect, the processor 806, the processors 810, the display controller 826, the memory 832, the CODEC 834, the wireless controller 840, and the transceiver 850 are included in a system-in-package or the system-on-chip device 822. In a particular aspect, an input device 830, such as a touchscreen and/or keypad, and a power supply 844 are coupled to the system-on-chip device 822. Moreover, in a particular aspect, as illustrated in FIG. 8, the display 828, the input device 830, the speaker 848, the microphone 846, the antenna 842, and the power supply 844 are external to the system-on-chip device 822. However, each of the display 828, the input device 830, the speaker 848, the microphone 846, the antenna 842, and the power supply 844 can be coupled to a component of the system-on-chip device 822, such as an interface or a controller. In an illustrative example, the device 800 corresponds to a mobile communication device, a smartphone, a cellular phone, a laptop computer, a computer, a tablet computer, a personal digital assistant, a display device, a television, a gaming console, a music player, a radio, a digital video player, an optical disc player, a tuner, a camera, a navigation device, a decoder system, an encoder system, or any combination thereof.

In an illustrative aspect, the processors 810 may be operable to perform signal encoding and decoding operations in accordance with the described techniques. For example, the microphone 846 may capture an audio signal (e.g., the audio signal 102 of FIG. 1). The ADC 804 may convert the captured audio signal from an analog waveform into a digital waveform that includes digital audio samples. The processors 810 may process the digital audio samples. The echo canceller 812 may reduce an echo that may have been created by an output of the speaker 848 entering the microphone 846.

The vocoder encoder 836 may compress digital audio samples corresponding to a processed speech signal and may form a transmit packet (e.g. a representation of the compressed bits of the digital audio samples). For example, the transmit packet may correspond to at least a portion of the output bit stream 199 of FIG. 1 or the output bit stream 299 of FIG. 2. The transmit packet may be stored in the memory 832. The transceiver 850 may modulate some form of the transmit packet (e.g., other information may be appended to the transmit packet) and may transmit the modulated data via the antenna 842.

As a further example, the antenna 842 may receive incoming packets that include a receive packet. The receive packet may be sent by another device via a network. For example, the receive packet may correspond to at least a portion of the bit stream 302 of FIG. 3. The vocoder decoder 838 may decompress and decode the receive packet to generate reconstructed audio samples (e.g., corresponding to the synthesized audio signal 399). The echo canceller 812 may remove echo from the reconstructed audio samples. The DAC 802 may convert an output of the vocoder decoder 838 from a digital waveform to an analog waveform and may provide the converted waveform to the speaker 848 for output.

In conjunction with the described aspects, an apparatus is disclosed that includes first means for encoding a first frame of an audio signal. For example, the first means for encoding may include the MDCT encoder 120 of FIG. 1, the processor 806, the processors 810, the MDCT encoder 860 of FIG. 8, one or more devices configured to encode a first frame of an audio signal (e.g., a processor executing instructions stored at a computer-readable storage device), or any combination thereof. The first means for encoding may be configured to generate, during encoding of the first frame, a baseband signal that includes content corresponding to a high band portion of the audio signal.

The apparatus also includes second means for encoding a second frame of the audio signal. For example, the second means for encoding may include the ACELP encoder 150 of FIG. 1, the processor 806, the processors 810, the ACELP encoder 862 of FIG. 8, one or more devices configured to encode a second frame of the audio signal (e.g., a processor executing instructions stored at a computer-readable storage device), or any combination thereof. Encoding the second frame may include processing the baseband signal to generate high band parameters associated with the second frame.

Those of skill would further appreciate that the various illustrative logical blocks, configurations, modules, circuits, and algorithm steps described in connection with the aspects disclosed herein may be implemented as electronic hardware, computer software executed by a processing device such as a hardware processor, or combinations of both. Various illustrative components, blocks, configurations, modules, circuits, and steps have been described above generally in terms of their functionality. Whether such functionality is implemented as hardware or executable software depends upon the particular application and design constraints imposed on the overall system. Skilled artisans may implement the described functionality in varying ways for each particular application, but such implementation decisions should not be interpreted as causing a departure from the scope of the present disclosure.

The steps of a method or algorithm described in connection with the aspects disclosed herein may be embodied directly in hardware, in a software module executed by a processor, or in a combination of the two. A software module may reside in a memory device, such as RAM, MRAM, STT-MRAM, flash memory, ROM, PROM, EPROM, EEPROM, registers, hard disk, a removable disk, or a CD-ROM. An exemplary memory device is coupled to the processor such that the processor can read information from, and write information to, the memory device. In the alternative, the memory device may be integral to the processor. The processor and the storage medium may reside in an ASIC. The ASIC may reside in a computing device or a user terminal. In the alternative, the processor and the storage medium may reside as discrete components in a computing device or a user terminal.

The previous description of the disclosed examples is provided to enable a person skilled in the art to make or use the disclosed examples. Various modifications to these examples will be readily apparent to those skilled in the art, and the principles defined herein may be applied to other examples without departing from the scope of the disclosure. Thus, the present disclosure is not intended to be limited to the aspects shown herein but is to be accorded the widest scope possible consistent with the principles and novel features as defined by the following claims.

What is claimed is:

1. A method for encoding an audio signal, the method comprising:

encoding a first frame of the audio signal using a first domain analysis at a first encoder;

generating, during encoding of the first frame, a baseband signal corresponding to a high band estimate of the audio signal or to a synthesized version of at least a portion of the audio signal; and encoding a second frame of the audio signal using a second domain analysis at a second encoder by processing first data representing the baseband signal and second data representing a high band portion of the second frame to generate high band parameters associated with the second frame.

2. The method of claim 1, wherein the first domain analysis and the second domain analysis comprise a frequency domain analysis and a time domain analysis, respectively, and wherein the second frame sequentially follows the first frame in the audio signal.

3. The method of claim 1, wherein the first frame of the audio signal is encoded using a transform-based encoder.

4. The method of claim 1, wherein the first frame of the audio signal is encoded using a modified discrete cosine transform (MDCT) encoder.

5. The method of claim 1, wherein the second frame of the audio signal is encoded using a linear prediction (LP)-based encoder that stores the first data and the second data in a target signal buffer.

6. The method of claim 1, wherein the second frame of the audio signal is encoded using an algebraic code-excited linear prediction (ACELP) encoder configured to perform bandwidth extension.

7. The method of claim 1, wherein generating the baseband signal includes performing a flip operation and a decimation operation.

8. The method of claim 1, wherein generating the baseband signal does not include performing a high-order filtering operation and does not include performing a downmixing operation.

9. The method of claim 1, wherein the second encoder stores the first data in a first portion of a target signal buffer of the second encoder and stores the second data in a second portion of the target signal buffer.

10. The method of claim 1, wherein the first encoder and the second encoder are included in a mobile communication device.

11. The method of claim 1, wherein generating the baseband signal comprises using a local decoder of the first encoder, and further comprising copying the first data to a target signal buffer of the second encoder.

12. The method of claim 1, further comprising:

performing a flip operation and a decimation operation on the baseband signal to generate a result signal that approximates the high band portion of the audio signal; and populating a target signal buffer of the second encoder based on the result signal.

13. A method for decoding an audio signal, the method comprising:

receiving a bit stream of second bits based on a second frame of the audio signal encoded using a first domain analysis at a first encoder and of first bits based on a first frame of the audio signal encoded using a second domain analysis at a second encoder, the first frame encoded by processing first data representing a baseband signal and second data representing a high band portion of the first frame, wherein the baseband signal is produced by the first encoder based on a high band estimate of a third frame or a synthesized version of at least a portion of the third frame;

decoding, at a device that includes a first decoder and a second decoder, an encoded version of the first frame using the second decoder and the first bits, the second decoder generating overlap data that corresponds to a portion of the second frame; and decoding an encoded version of the second frame using the first decoder and the second bits, the decoding including applying a smoothing operation using the overlap data from the second decoder.

14. The method of claim 13, wherein the first decoder comprises a modified discrete cosine transform (MDCT) decoder, wherein the second decoder comprises an algebraic code-excited linear prediction (ACELP) decoder that performs calculations based on bandwidth extension parameters, and wherein the overlap data comprises data corresponding to 20 audio samples of the second frame.

15. The method of claim 13, wherein the first domain analysis and the second domain analysis comprise a frequency domain analysis and a time domain analysis, respectively.

16. The method of claim 13, wherein the smoothing operation includes a crossfade operation, and wherein the first decoder and the second decoder are included in a mobile communication device.

17. An apparatus for encoding an audio signal, the apparatus comprising:

an antenna;

a first encoder configured to:

encode a first frame of the audio signal based on a first domain analysis; and generate, during encoding of the first frame, a baseband signal corresponding to a high band estimate of the audio signal or to a synthesized version of at least a portion of the audio signal;

a second encoder configured to encode a second frame of the audio signal based on:

a second domain analysis; and first data representing the baseband signal and second data representing a high band portion of the second frame, the second encoder configured to generate high band parameters associated with the second frame; and a transmitter coupled to the antenna and configured to transmit an encoded audio signal associated with the baseband signal.

18. The apparatus of claim 17, wherein the first domain analysis and the second domain analysis comprise a frequency domain analysis and a time domain analysis, respectively, and wherein the second frame sequentially follows the first frame in the audio signal.

19. The apparatus of claim 17, wherein:

the first encoder comprises a modified discrete cosine transform (MDCT) encoder, the second encoder comprises an algebraic code-excited linear prediction (ACELP) encoder configured to store at least one of the first data or the second data in a target signal buffer and to perform bandwidth extension, and the first encoder and the second encoder are integrated into a mobile communication device.

20. The apparatus of claim 17, wherein the first encoder is configured to generate the baseband signal using a flip operation and using a decimation operation without performing a high-order filtering operation and without performing a downmixing operation.

21. An apparatus for encoding an audio signal, the apparatus comprising:

an antenna;

a first encoder configured to encode a first frame of an audio signal based on a first domain analysis;

a second encoder configured to:

during encoding of a second frame of the audio signal based on a second domain analysis, generate a signal estimate of a first portion of the first frame;

populate a buffer of the second encoder with first data based on the signal estimate and with second data representing a high band portion of the second frame of the audio signal; and generate high band parameters associated with the second frame based on the first data and the second data stored in the buffer; and a transmitter coupled to the antenna and configured to transmit an encoded audio signal associated with the audio signal.

22. The apparatus of claim 21, wherein the signal estimate is based on an extrapolation operation based on data of the second frame.

23. The apparatus of claim 21, wherein the signal estimate is based on a backward linear prediction.

24. The apparatus of claim 21, wherein the signal estimate is based on energy information indicating an energy associated with the first frame.

25. The apparatus of claim 24, further comprising a first buffer coupled to the first encoder, wherein the energy associated with the first frame is determined based on a first energy associated with the first buffer, wherein the energy associated with the first frame is determined based on a second energy associated with a high band portion of the first buffer.

26. The apparatus of claim 21, further comprising a modulator configured to modulate the encoded audio signal.

27. The apparatus of claim 26, wherein the antenna, the transmitter, and the modulator are integrated into a mobile communication device.

28. The apparatus of claim 21, wherein the first domain analysis and the second domain analysis comprise a frequency domain analysis and a time domain analysis, respectively, wherein the signal estimate is based at least in part on a first frame type of the first frame, a second frame type of the second frame, or both, wherein the first frame type comprises a voiced frame type, an unvoiced frame type, a transient frame type, or a generic frame type, and wherein the second frame type comprises the voiced frame type, the unvoiced frame type, the transient frame type, or the generic frame type.

29. The apparatus of claim 21, wherein the first portion of the first frame is approximately 5 milliseconds in duration and wherein the second frame is approximately 20 milliseconds in duration.

30. The apparatus of claim 21, wherein the signal estimate is based on an energy associated with a locally decoded low band portion of the first frame, a locally decoded high band portion of the first frame, or both.

31. An apparatus for decoding an audio signal, the apparatus comprising:

a receiver configured to receive a bit stream of second bits corresponding to a second frame of the audio signal encoded via a first domain analysis at a first encoder and of first bits corresponding to a first frame of the audio signal encoded via a second domain analysis at a second encoder, the first frame encoded by processing first data representing a baseband signal and second data representing a high band portion of the first frame, wherein the baseband signal is produced by the first encoder based on a high band estimate of a third frame or a synthesized version of at least a portion of the third frame;

a first decoder configured to, during decoding of an encoded version of the second frame based on the second bits, apply a smoothing operation using overlap data that corresponds to a portion of the second frame; and a second decoder configured to decode an encoded version of the first frame and to generate the overlap data.

32. The apparatus of claim 31, further comprising an antenna coupled to the receiver, wherein the first domain analysis and the second domain analysis comprise a frequency domain analysis and a time domain analysis, respectively, wherein the smoothing operation includes a crossfade operation, and wherein the antenna, the receiver, the first decoder, and the second decoder are integrated into a mobile communication device.

33. A computer-readable storage device storing instructions that, when executed by a processor, cause the processor to perform operations for encoding an audio signal comprising:

encoding a first frame of the audio signal using a first domain analysis at a first encoder;

generating, during encoding of the first frame, a baseband signal corresponding to a high band estimate of the audio signal or to a synthesized version of at least a portion of the audio signal; and encoding a second frame of the audio signal using a second domain analysis at a second encoder, wherein encoding the second frame includes processing first data representing the baseband signal and second data representing a high band portion of the second frame to generate high band parameters associated with the second frame.

34. The computer-readable storage device of claim 33, wherein the first encoder comprises a transform-based encoder, and wherein the second encoder comprises a linear prediction (LP)-based encoder.

35. The computer-readable storage device of claim 33, wherein generating the baseband signal includes performing a flip operation and a decimation operation, and wherein the operations further comprise populating a first portion of a target signal buffer of the second encoder based at least partially on the first data and populating a second portion of the target signal buffer based at least partially on the second data.

36. The computer-readable storage device of claim 33, wherein the baseband signal is generated using a local decoder of the first encoder.

37. An apparatus for encoding an audio signal, the apparatus comprising:

first means for encoding a first frame of the audio signal based on a first domain analysis, the first means for encoding configured to generate, during encoding of the first frame, a baseband signal corresponding to a high band estimate of the audio signal or to a synthesized version of at least a portion of the audio signal;

second means for encoding, based on a second domain analysis, a second frame of the audio signal based on processing first data representing the baseband signal and second data representing a high band portion of the second frame to generate high band parameters associated with the second frame; and means for transmitting an encoded audio signal associated with the audio signal.

38. The apparatus of claim 37, wherein the first domain analysis and the second domain analysis comprise a frequency domain analysis and a time domain analysis, respectively, and wherein the first means for encoding, the second means for encoding, and the means for transmitting are integrated into at least one of a mobile communication device, a smartphone, a cellular phone, a laptop computer, a computer, a tablet computer, a personal digital assistant, a display device, a television, a gaming console, a music player, a radio, a digital video player, an optical disc player, a tuner, a camera, a navigation device, a decoder system, or an encoder system.

39. The apparatus of claim 37, wherein the first means for encoding is further configured to generate the baseband signal by performing a flip operation and a decimation operation, and wherein the second means for encoding is further configured to store the first data and the second data in a target signal buffer.

40. The apparatus of claim 37, wherein the first means for encoding is further configured to generate the baseband signal using a local decoder.

* * * * *